US007944426B2

(12) United States Patent
Yamashita

(10) Patent No.: US 7,944,426 B2
(45) Date of Patent: May 17, 2011

(54) DISPLAY DEVICE AND DRIVING CIRCUIT FOR CAPACITANCE LOAD THEREOF

(75) Inventor: Masakatsu Yamashita, Kobe (JP)

(73) Assignee: TPO Hong Kong Holding Limited, Shatin (HK)

( * ) Notice: Subject to any disclaimer, the term of this patent is extended or adjusted under 35 U.S.C. 154(b) by 1187 days.

(21) Appl. No.: 11/637,826

(22) Filed: Dec. 13, 2006

(65) Prior Publication Data

US 2007/0132696 A1 Jun. 14, 2007

(30) Foreign Application Priority Data

Dec. 13, 2005 (JP) ..... 2005-358377

(51) Int. Cl.
*G09G 3/36* (2006.01)

(52) U.S. Cl. ..... 345/98; 345/204

(58) Field of Classification Search ..... 345/52, 345/55, 83, 87–100, 204, 211–214; 349/42; 330/251–255, 257

See application file for complete search history.

(56) References Cited

U.S. PATENT DOCUMENTS

| | | | | |
|---|---|---|---|---|
| 5,399,992 | A | 3/1995 | Itakura et al. | |
| 6,411,162 | B2 * | 6/2002 | Minamizaki et al. | 330/255 |
| 6,480,178 | B1 * | 11/2002 | Itakura et al. | 345/89 |
| 7,119,802 | B2 * | 10/2006 | Suyama et al. | 345/208 |
| 2002/0093475 | A1 | 7/2002 | Hashimoto | |
| 2003/0112215 | A1 | 6/2003 | Hector et al. | |
| 2003/0151572 | A1 | 8/2003 | Kumada et al. | |
| 2004/0036670 | A1 | 2/2004 | Chung | |
| 2004/0207434 | A1 | 10/2004 | Miura | |
| 2004/0263504 | A1 | 12/2004 | Kato | |

FOREIGN PATENT DOCUMENTS

| | | | |
|---|---|---|---|
| CN | 1485810 | A | 3/2004 |
| EP | 1465147 | A2 | 10/2004 |
| JP | 2003-330429 | A | 11/2003 |
| JP | 2004-29316 | A | 1/2004 |

* cited by examiner

*Primary Examiner* — Quan-Zhen Wang
*Assistant Examiner* — Mansour M Said
(74) *Attorney, Agent, or Firm* — Birch, Stewart, Kolasch & Birch, LLP

(57) ABSTRACT

A driving circuit and display device reducing waste of a bias current of an amplifier and conserving power. The driving circuit includes a driving signal supply mechanism, an amplifier mechanism and a control mechanism. The supply mechanism supplies a driving signal having a target voltage represented during periodic update. The amplifier mechanism has an amplifier part, a current-adjustable constant current source and a switch part. The driving signal is input to the amplifier part, which generates an output to a capacitance load according to the driving signal. The current source supplies and regulates a passing rate of the bias current to the amplifier part. The switch part performs ON/OFF control to the current output to the current source. The control mechanism detects a difference between the previous and present values of the target voltage to change a current value of the current source.

13 Claims, 13 Drawing Sheets

DISPLAY DEVICE AND DRIVING CIRCUIT FOR CAPACITANCE LOAD THEREOF

BACKGROUND OF THE INVENTION

1. Field of Invention

The invention relates to a driving circuit for a display device, and, in particular, to a driving circuit supplying a target voltage signal to a capacitance load of a display device. More specifically, the invention relates to a display driving circuit applying a voltage corresponding to a pixel information signal across a row electrode in a display device such as a liquid crystal display panel. The invention also relates to a display device using the driving circuit.

2. Related Art

FIG. 1 is a circuit diagram showing an aspect of a driving circuit used in a conventional liquid crystal display device.

The aspect of the driving circuit of FIG. 1 supplies a driving voltage signal of corresponding pixel information to a source bus coupled to a row electrode of a liquid crystal display device, such as a source electrode of a thin film transistor (TFT) of an active device, which drives a pixel and extends along a first axis of a frame region. For example, each source bus can be provided with one driving circuit.

The driving circuit includes a grayscale voltage generating circuit 10 supplying digital pixel data serving as the pixel information signal, an amplifier 20 having an input coupled to an output of the grayscale voltage generating circuit 10, and a switch 30 controlling the power of the amplifier 20 (i.e., the ON/OFF of the bias current). The output of the amplifier 20 is connected to the source bus through an output line 40.

The grayscale voltage generating circuit 10 disposed in a primary stage comprises digital-to-analog converters and serves as a driving signal supply mechanism supplying a driving signal of a target voltage. The grayscale voltage generating circuit 10 has a voltage-dividing circuit formed by a plurality of resistor elements connected in series. As shown, the voltage-dividing circuit has one end coupled to a positive side power voltage Vdd and the other end coupled to a negative side power voltage Vss. The voltage-dividing circuit divides the voltage between Vdd and Vss, and thus generates a plurality of ascending or descending grayscale voltages. Common connection points between the resistor elements are respectively connected to first ends of switch elements, and second ends of the switch elements are connected together and serve as an output terminal of the grayscale voltage generating circuit 10. The switch elements can be individually controlled to be ON according to the input pixel data Vdata. Thus, among various grayscale voltages formed by the voltage-dividing circuit, only the grayscale voltage, which corresponds to the switch element turned on according to the pixel data Vdata, can be output as the driving signal Vin.

The amplifier 20 disposed in the secondary stage includes complementarily connected n-channel and p-channel field effect transistors (FET) 21 and 22 having gates to commonly receive the driving signal Vin, and a constant current source 23 having one end connected to a source of the n-channel FET 21. The p-channel FET 22 has a drain connected to the positive side power voltage Vdd. The other end of the constant current source 23 is coupled to one end of the switch element 30. The other end of the switch element 30 is connected to the negative side power voltage Vss. The switch element 30 is controlled to be ON/OFF according to a control signal C0 of the control circuit (not shown). A closed loop is formed between positive and negative power voltages of the amplifier 20 only when the switch element 30 is ON. The output current of the constant current source 23 serves as a bias current, and the amplifier 20 has a driving ability corresponding to the bias current necessary to achieve the amplifying effect. That is, the amplifier 20 outputs the driving signal Vin corresponding to the input according to a passing rate corresponding to the inherent bias current of the constant current source 23. The source of the p-channel FET 22 and the drain of the n-channel FET 21 are connected together, and the common connection portion serves as the output terminal of the amplifier, connected to the output line 40 or the source bus.

The source bus regulates the potential of the source electrode of the TFT formed in the display region. For example, when the column selection signal (or the wire selection signal, the gate control signal) in the gate bus of the column electrode, which crosses the source bus and extends along a second axis of the frame region, enables the TFT to be ON, the supplied potential of the driving voltage signal is applied to the liquid crystal part in the liquid crystal layer from the pixel electrode coupled to the drain electrode in the TFT. On an opposite side of the pixel electrode, a common electrode 50 clamping the liquid crystal layer and substantially crossing over the full region of the frame is provided. The liquid crystal part changes the molecule orientation and thus the optical modulation state thereof according to the voltage generated between the pixel electrode and the common electrode 50. In this aspect, the source bus extends greatly in the frame region, and the capacitor Ccol located between the output line 40 and the common electrode 50 may be regarded as an equivalent capacitor of the source bus and the liquid crystal layer.

FIG. 2 shows operation of the driving circuit, wherein the topmost stage represents the waveform of the driving signal Vin, the secondary stage represents the waveform of the horizontal sync signal of the timing signal of the pixel data Vdata, the third stage represents the waveform of the output voltage Vout of the amplifier 20, and the fourth stage represents the waveform of the amplifier 20 according to the bias current of the constant current source 23, and the bottommost stage represents the waveform of the switch control signal C0.

The horizontal sync signal can be used to regulate the update timing of the pixel data Vdata. In this example, one horizontal scan period (the one scan line) is divided according to the time of the horizontal sync signal falling to the low level. Thus, the starting period and the ending period of the column are displayed according to the time, and the pixel data Vdata is updated in each column.

Conditions under which the horizontal scan period of the pixel data Vdata is shifted to the $(n-1)^{th}$ column, the $n^{th}$ column, the $(n+1)^{th}$ column, and the $(n+2)^{th}$ column are detailed as follows.

In the $n^{th}$ column, the grayscale voltage generating circuit 10 generates the grayscale voltage (i.e., the driving signal Vin) corresponding to the pixel data Vdata in response to the drop of the horizontal sync signal. At this time, any switch in the circuit 10 is ON corresponding to the data. Next, when the horizontal sync signal rises, the control signal C0 of the switch 30 becomes the high level and is held high in the entire fixed period TA. The switch 30 is ON when the control signal C0 is at the high level. Thus, the constant current source 23 can output the current in the entire fixed period TA to provide the power to the complementary transistors 21 and 22 according to the bias current of the constant current source 23. The value of the bias current is the inherent fixed current value Ia of the constant current source 23. Thus, the output Vout of the amplifier 20 slowly approaches the value of the driving signal Vin serving as the target value in the entire fixed period TA at the passing rate regulated by the bias current value Ia. In this example, the value of Vin of the $(n-1)^{th}$ column is the minimum, and the value of Vin of the $n^{th}$ column is the maximum.

It is possible to set the bias current value Ia and the period TA in advance such that the output Vout can be changed according to the maximum variation (maximum output amplitude) Vpp from the minimum to the maximum of Vin.

Next, in the $(n+1)^{th}$ column, the grayscale voltage generating circuit 10 generates the driving signal Vin corresponding to the pixel data Vdata in response to the drop of the horizontal sync signal. Also, the control signal C0 of the switch 30 ascends to the high level and is kept high in the entire fixed period TA in response to the rise of the horizontal sync signal, and the switch 30 and constant current source 23 are controlled. In this example, however, the value of Vin of the $(n+1)^{th}$ column becomes an intermediate value, and the output Vout can reach the target value of Vin in the middle of the period TA but not the end of the period.

In addition, grayscale voltage generating circuit 10, switch 30, and constant current source 23 similarly operate in the $(n+2)^{th}$ column. In this example, however, the value of Vin of the $(n+2)^{th}$ column is the same as the intermediate value of the previous column. In the period TA, the input will not be changed even if the bias current is applied to the complementary transistors 21 and 22, so the output Vout will not be changed.

Accordingly, target voltage is achieved by the beginning or middle of the bias period TA, in addition to the request on the column of the maximum output amplitude Vpp, a condition disadvantageous to power conservation after the target voltage is reached, since bias currents of the amplifier transistors 21 and 22 are not utilized.

SUMMARY OF THE INVENTION

In view of the foregoing, the invention provides a driving circuit and a display device capable of reducing waste of bias current in an amplifier, conserving power accordingly.

The invention also provides a driving circuit and a display device capable of reducing power consumption simply.

Accordingly, the invention discloses a driving circuit for driving a capacitance load of a display device. The driving circuit includes a driving signal supply mechanism, an amplifier mechanism, and a control mechanism. The driving signal supply mechanism supplies a driving signal having a target voltage represented during periodic update. The amplifier mechanism includes an amplifier part, a current-adjustable constant current source, and a switch part. The amplifier part receives the driving signal serving as an input and generates an output to the capacitance load according to the driving signal. The current-adjustable constant current source supplies and regulates a passing rate of a bias current to the amplifier part. The switch part performs ON/OFF control to a current output from the constant current source. The control mechanism detects a difference between a previous value and a present value of the target voltage during update to change a current value of the constant current source such that the bias current is higher when the difference is larger.

Accordingly, power is conserved because the bias current, which corresponds to the variation when the target voltage is changed from a previous value to a present value, is not excessive.

In this aspect, the control mechanism includes a buffer memory, a subtracter, and a memory. The buffer memory stores the previous value and the present value of the driving signal. The subtracter obtains the difference between the previous value and the present value recorded in the buffer memory. The memory contains suitable current values of the constant current source according to the difference. The constant current source sets the current value read from the memory according to an output of the subtracter. In addition, the control mechanism may include a differential amplifier, and a sample/hold mechanism. The differential amplifier receives the input of the amplifier mechanism, which serves as an input, and the output of the amplifier mechanism, which serves as another input, and outputs a difference between the inputs of the amplifier mechanism. The sample/hold mechanism samples and holds a voltage corresponding to the difference or a voltage of each input of the differential amplifier before the output of the amplifier mechanism changes from the previous value of the target voltage to the present value of the target voltage. The constant current source can set the current value according to the output of the differential amplifier, which is obtained according to the held voltage or the input of the held voltage. Alternatively, the control mechanism may include a differential amplifier, a sample/hold mechanism, and a memory. The differential amplifier receives the input of the amplifier mechanism, which serves as an input, and the output of the amplifier mechanism, which serves as another input, and outputs a difference between the inputs of the amplifier mechanism. The sample/hold mechanism samples and holds a voltage corresponding to the difference or a voltage of each input of the differential amplifier before the output of the amplifier mechanism changes from the previous value of the target voltage to the present value of the target voltage. The memory contains suitable current values of the constant current source according to a digital value of a voltage of the output of the differential amplifier, which is obtained according to the held voltage or the input of the held voltage. The constant current source sets the current value, which is read from the memory, according to a digital value of the difference. Thus, the invention can achieve the desired objects with a simple structure. Furthermore, the bias current can be controlled to at least two stages, and power consumption reduced while the stages of the bias current increase.

The invention also discloses a driving circuit for driving a capacitance load of a display device. The driving circuit includes a driving signal supply mechanism, an amplifier mechanism, and a control mechanism. The driving signal supply mechanism supplies a driving signal having a target voltage represented during periodic update. The amplifier mechanism includes an amplifier part, a current-adjustable constant current source, and a switch part. The amplifier part receives the driving signal serving as an input and generates an output to the capacitance load according to the driving signal. The current-adjustable constant current source supplies and regulates a passing rate of a bias current to the amplifier part. The switch part performs ON/OFF control to a current output from the constant current source. The control mechanism detects a difference between a previous value and a present value of the target voltage during update to change a length of a current output period. Thus, ON/OFF status of the switch part is controlled such that a sum of the bias current is higher when the difference is larger.

In addition, power is conserved because the bias current, which corresponds to the variation when the target voltage is changed from a previous value to a present value, is generated for a short time only.

In this aspect, the control mechanism includes a buffer memory, a subtracter, and a memory. The buffer memory stores the previous value and the present value of the driving signal. The subtracter obtains the difference between the previous value and the present value recorded in the buffer memory. The memory stores, in advance, suitable lengths of the current output period of the constant current source according to the difference. The switch part sets, according to an output of the subtracter, the constant current source to ON in a period corresponding to the length of the current output period read from the memory. In addition, the control mechanism may include a differential amplifier and a sample/hold mechanism. The differential amplifier receives the input of the amplifier mechanism, which serves as an input, and the output of the amplifier mechanism, which serves as another input, and outputs a difference between the inputs of the amplifier mechanism. The sample/hold mechanism samples and holds a voltage corresponding to the difference or a voltage of each of the inputs of the differential amplifier before the output of the amplifier mechanism changes from the previous value of the target voltage to the present value of the target voltage. The constant current source is set to ON by the switch part according to the output voltage of the differential amplifier, obtained according to the held voltage or the input of the held voltage, in the current output period corresponding to the length. Alternatively, the control mechanism may include a differential amplifier, a sample/hold mechanism, and a memory. The differential amplifier receives the input of the amplifier mechanism, which serves as an input, and the output of the amplifier mechanism, which serves as another input, and outputs a difference between the inputs of the amplifier mechanism. The sample/hold mechanism samples and holds a voltage corresponding to the difference or a voltage of each of the inputs of the differential amplifier before the output of the amplifier mechanism changes from the previous value of the target voltage to the present value of the target voltage. The memory stores, in advance, suitable lengths of the current output period of the constant current source according to a digital value of a voltage of the output of the differential amplifier, obtained according to the held voltage or the input of the held voltage. The constant current source is set to ON by the switch part according to a digital value of the difference in the length of the current output period, which is read from the memory. Therefore, the invention can achieve the desired objects simply. Furthermore, the sum of the bias current can be controlled to at least two stages, and the power consumption can be reduced while the stages of the bias current increase.

Accordingly, the target voltage can be updated during each horizontal scan period, or can be a grayscale voltage.

In addition, the invention also discloses a display device including a row driving circuit, which can be any of the above mentioned aspects. The display device further includes a plurality of row electrodes extending along a first axis of a frame. The amplifier mechanism is disposed in each of the row electrodes. The outputs of the amplifier mechanism are coupled to the row electrodes. The control mechanism is disposed in each of the row electrodes. For reduced circuit size, the display device may further include a plurality of row electrodes extending along a first axis of a frame. The amplifier mechanism is disposed in each of the row electrodes, and the outputs of the amplifier mechanism are coupled to the row electrode. The control mechanism provides common bias control of the amplifier mechanism associated with the row electrodes, and according to one maximum of the differences obtained by the amplifier mechanism associated with the row electrodes.

BRIEF DESCRIPTION OF THE DRAWINGS

The invention will become more fully understood from the detailed description given herein below illustration only, and thus is not limitative of the invention, and wherein.

DETAILED DESCRIPTION OF THE INVENTION

The invention will be apparent from the following detailed description, which proceeds with reference to the accompanying drawings, wherein the same references relate to the same elements.

Figure 1:
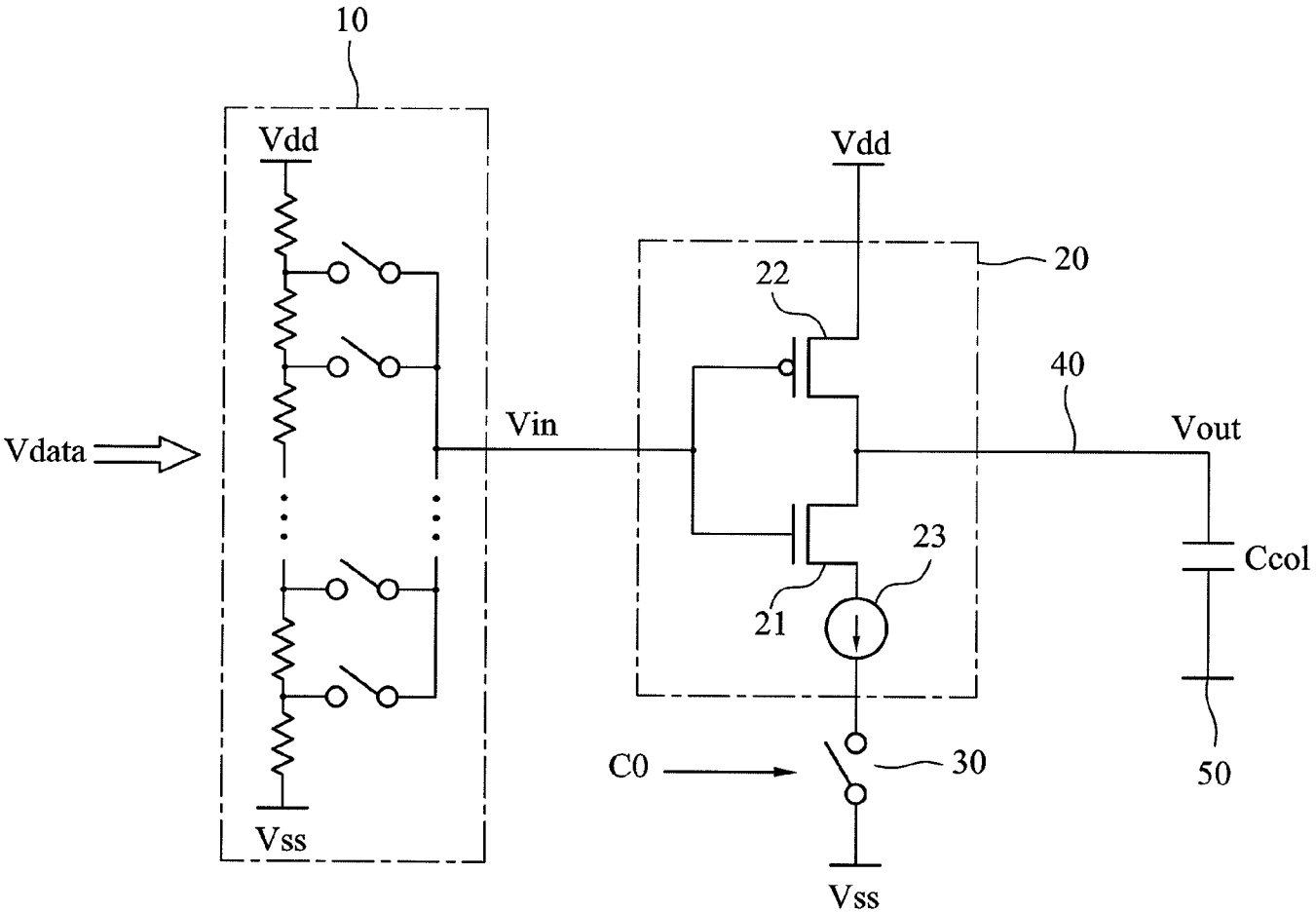
FIG. 1 ( PRIOR ART )
FIG. 1 is a circuit diagram showing a aspect of a driving circuit used in a conventional liquid crystal display device.
Figure 3:
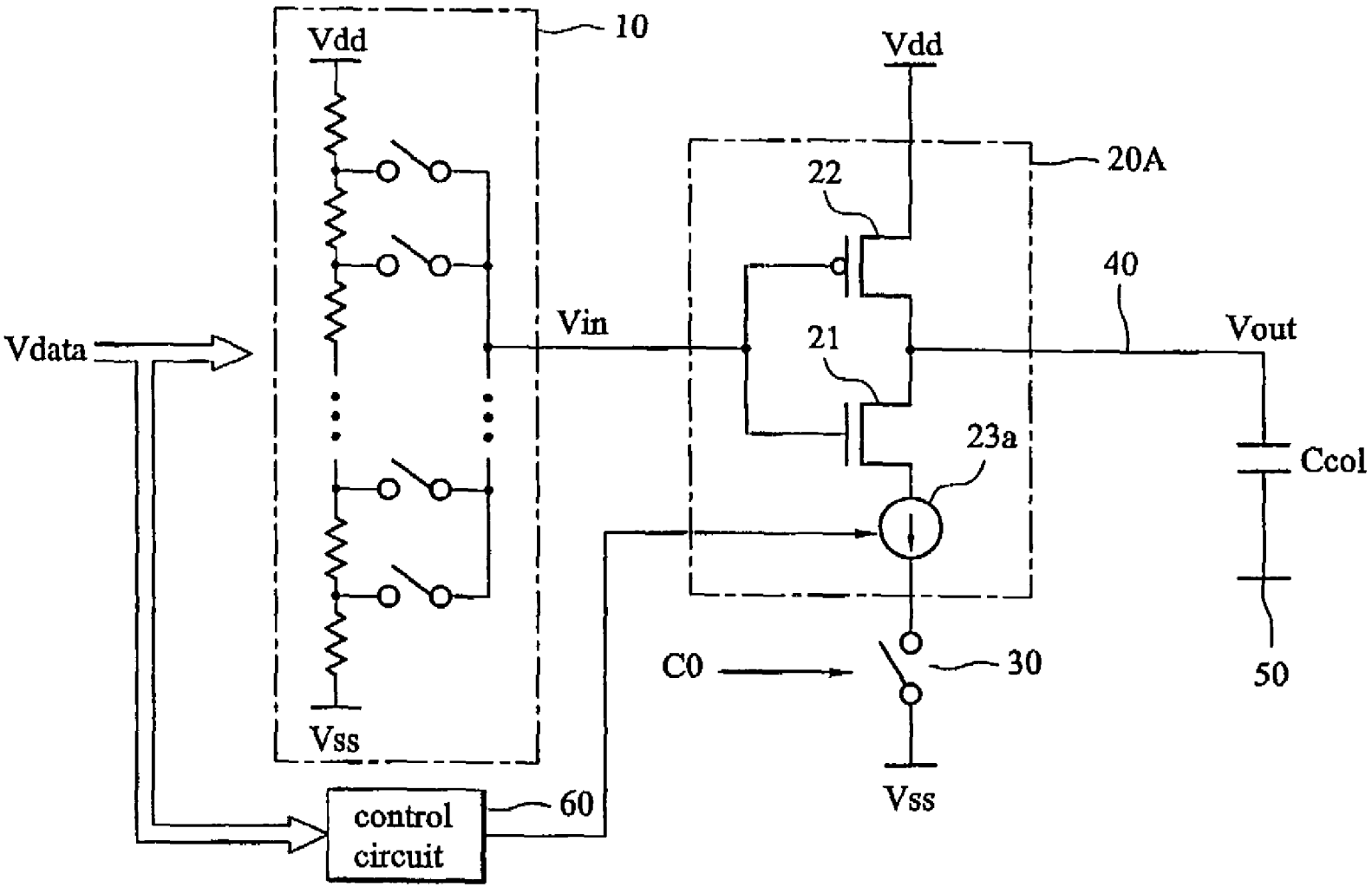
FIG. 3 is a circuit diagram showing an aspect of a row electrode driving circuit according to a first embodiment of the invention.

FIG. 3 is a circuit diagram showing an aspect of a row electrode driving circuit according to a first embodiment of the invention, wherein the same symbol denotes the same elements as FIG. 1.

The driving circuit of FIG. 3 is different from that of FIG. 1. A constant current source 23*a* of a modified amplifier 20A is modified such that the output current value thereof can be changed according to a bias control signal supplied from the outside of the amplifier. Also, a control circuit 60 receiving the pixel data Vdata is incorporated, wherein the control circuit 60 generates a suitable bias control signal according to the pixel data Vdata, and supplies the bias control signal to the constant current source 23*a* to control waste of bias current in the amplifier 20A by detecting a difference between a previous target value of the driving circuit and a present target value of the driving circuit, which becomes the difference between values of a previous column and a present column of the basic pixel data Vdata of the driving signal Vin. The output current value of the constant current source 23*a* is set according to the difference whenever the sub-pixel data Vdata and the driving signal Vin are updated.

Figure 4:
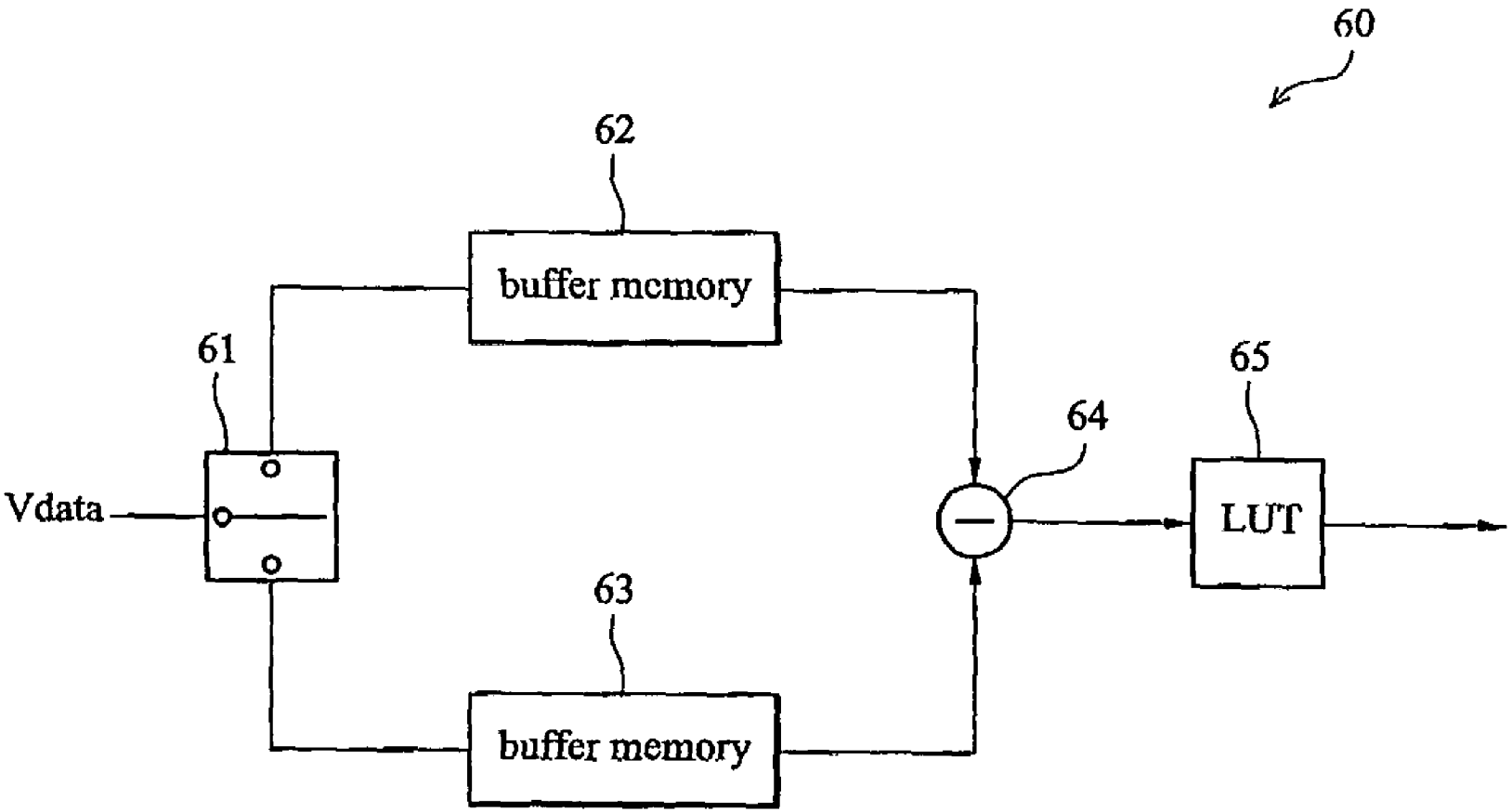
FIG. 4 is a block diagram showing an aspect of a control circuit in the driving circuit of FIG. 3.

FIG. 4 shows the embodied aspect of the control circuit 60. The control circuit 60 includes a switching circuit 61, buffer memories 62 and 63, a subtracter 64 and a look-up table (hereinafter referred to as LUT) 65. The switching circuit 61 has one input receiving the pixel data Vdata, selectively coupled to one end and the other end of the output. The buffer memories 62 and 63 respectively receive and record the pixel data coming from the one end and the other end of the output.

The subtracter 64 receives the data read from the buffer memories and calculates the difference between the values of the data. The LUT 65 has an input receiving the output of the subtracter 64 serving as the address signal and thus outputs the data specified by the address.

The input pixel data Vdata is updated in each column. Moreover, the switching circuit 61 in each column selectively provides the data to the buffer memory 62 and the buffer memory 63. Thus, in the buffer memories 62 and 63, the pixel data differing by one column, that is, the pixel data in two adjacent columns, is recorded as a previous value and a present value. The subtracter 64 obtains the difference between the pixel data of the adjacent columns and supplies the data corresponding to the difference to the LUT 65. The LUT 65 records, in advance, the data of the output value corresponding to the pixel data difference, and, using the difference to specify the address, reads the desired data. The read data serves as the bias control signal to be supplied to the constant current source 23*a*.

For example, when the LUT 65 records two kinds of data, as mentioned, the corresponding allocation between the pixel data difference and the memory data is performed.

Figure 5:
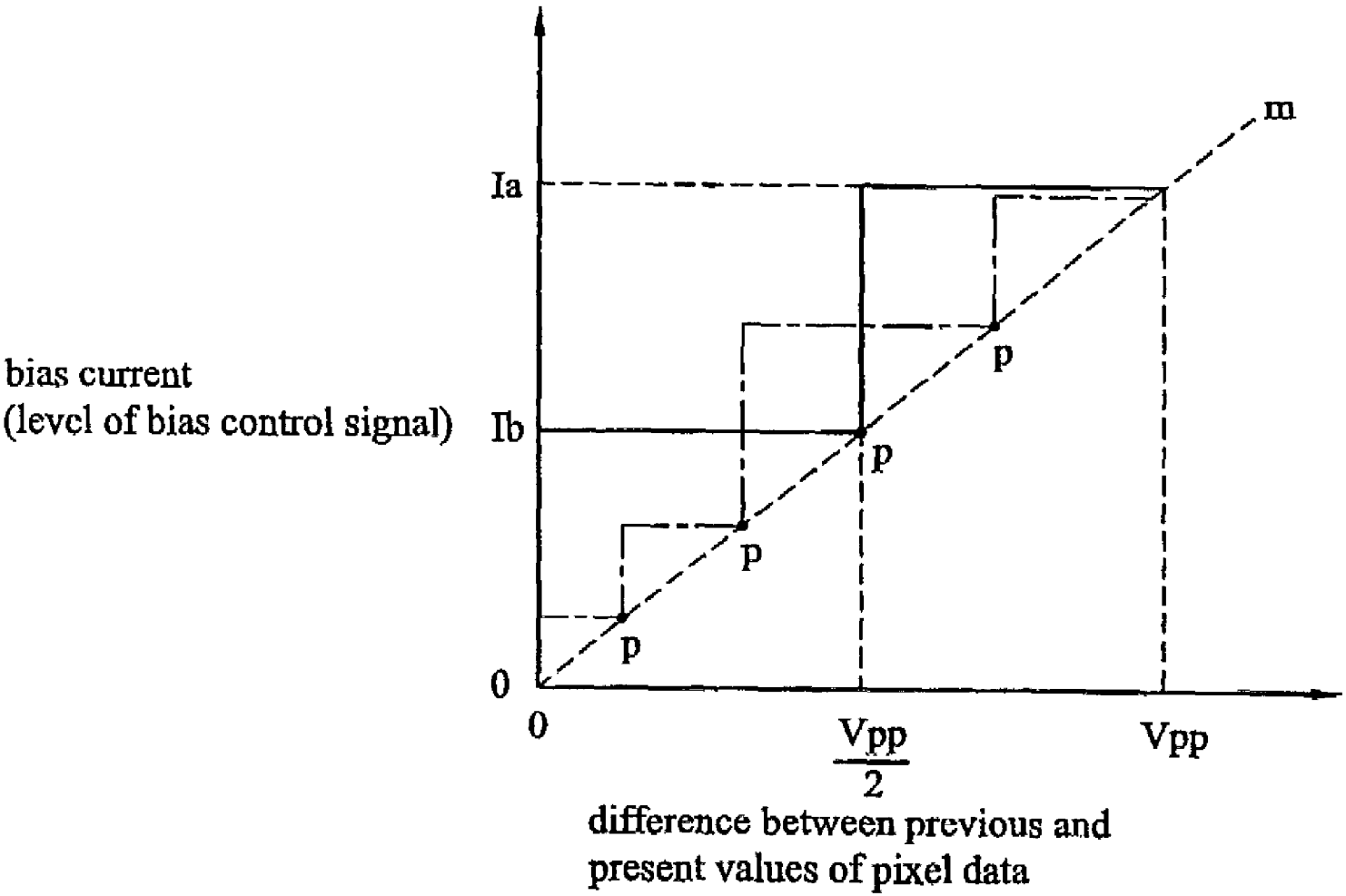
FIG. 5 shows a relationship between a pixel data difference and a bias current in the bias control of the driving circuit of FIG. 3.

For example, the maximum output amplitude of the amplifier 20A, that is one half of the peak-to-peak value Vpp, serves as a threshold value, and the memory data is determined according to whether the pixel data difference is greater or less than the threshold value. In other words, the individually and equally divided ranges obtained by dividing the acquirable range of the pixel data difference into two parts are restricted. Two values corresponding to the divided ranges are set as the memory data when the pixel data difference falls within a particular one of the divided ranges. A solid line in the graph of FIG. 5 represents the relationship between the value of the pixel data difference (the difference between the previous value and the present value of the pixel data) and the memory data value (the level of the bias control signal). The value of the bias current may be switched with one half (Vpp/2) of the difference serving as a bound according to the maximum Ia and the middle value Ib.

Also, two unequally divided ranges of the acquirable range of the pixel data difference may also be made, and the number of the unequally divided ranges may also be greater than two. No matter which condition is acquired, the memory data values of the LUT 65 are set such that the output current value of the constant current source 23*a* increases with the difference. That is, the bias current value of the amplifier 20A increases. The bias current control may have more than two stages, and the greater number of stages is preferred. The dashed line in the graph of FIG. 5 shows an example of four unequal stages of control. Also, for example, if the constant current source 23*a* represents the property of the dashed line m of FIG. 5, the level of the bias control signal (i.e., the memory data of the LUT 65) has to be regulated preferably such that the level of the bias control signal is equal to or greater than the value represented by the dashed line m. In addition, the switching time p of the bias current is preferably located on the dashed line m.

The memory data of the LUT 65 may have two different conditions. For example, the smaller value is allocated as the memory data of the LUT 65 with respect to the difference of the smaller divided range, and the larger value is allocated as the memory data of the LUT 65 with respect to the difference of the larger divided range. When the data value read from the LUT 65 is small, the low level bias control signal is supplied to the constant current source 23*a*; and when the data value is large, the high level bias control signal is supplied to the constant current source 23*a* to control the constant current source 23*a* to represent the low output current and the high output current.

When the number of kinds of memory data is greater than three, the memory data values are set with respect to the more than three individually divided ranges. As for the difference pertains to which of the divided ranges such that the data value read from the LUT 65 is larger, the bias control signal with the higher level is supplied to the constant current source 23*a* to control the constant current source 23*a* to represent the higher output current.

Figure 2:
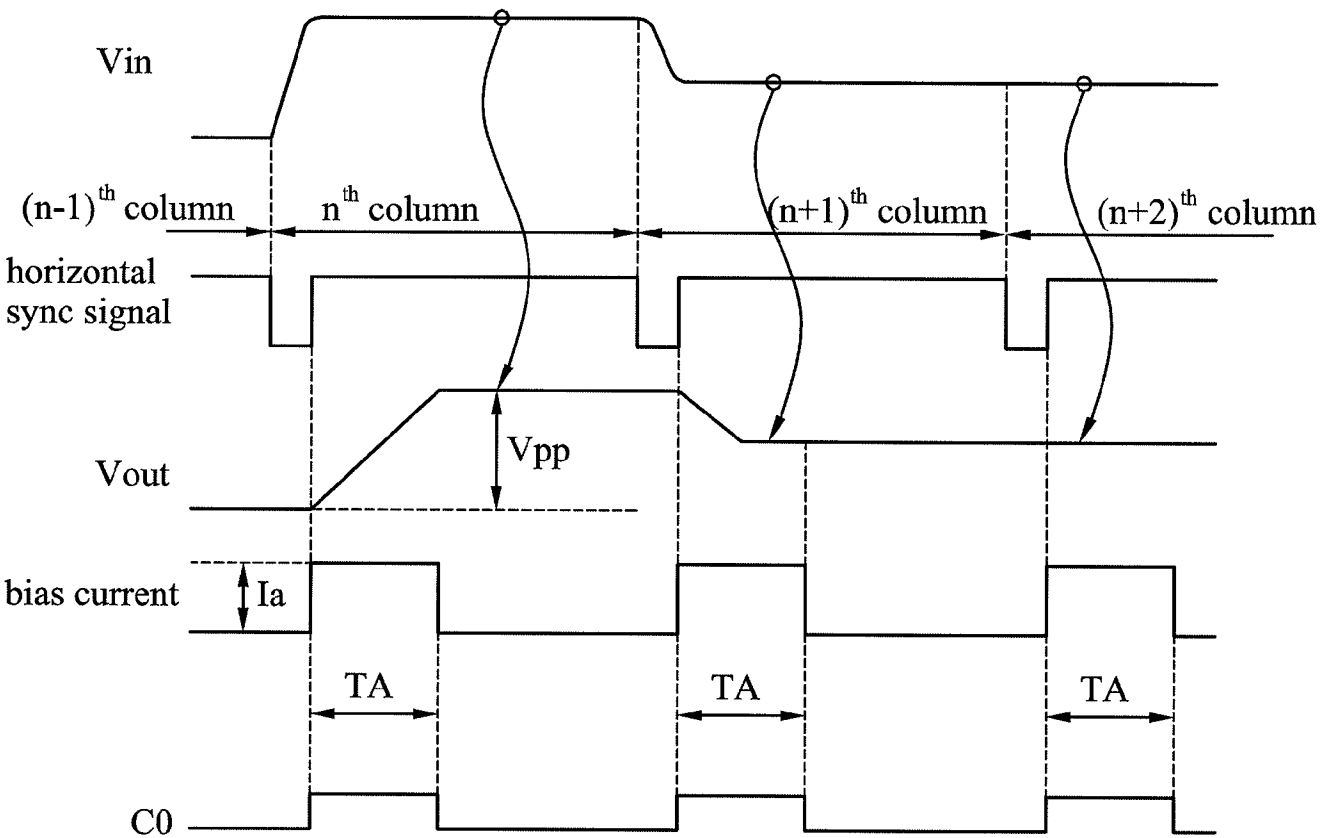
FIG. 2 ( PRIOR ART )
FIG. 2 is a timing chart showing waveforms of signals in the driving circuit of FIG. 1.
Figure 6:
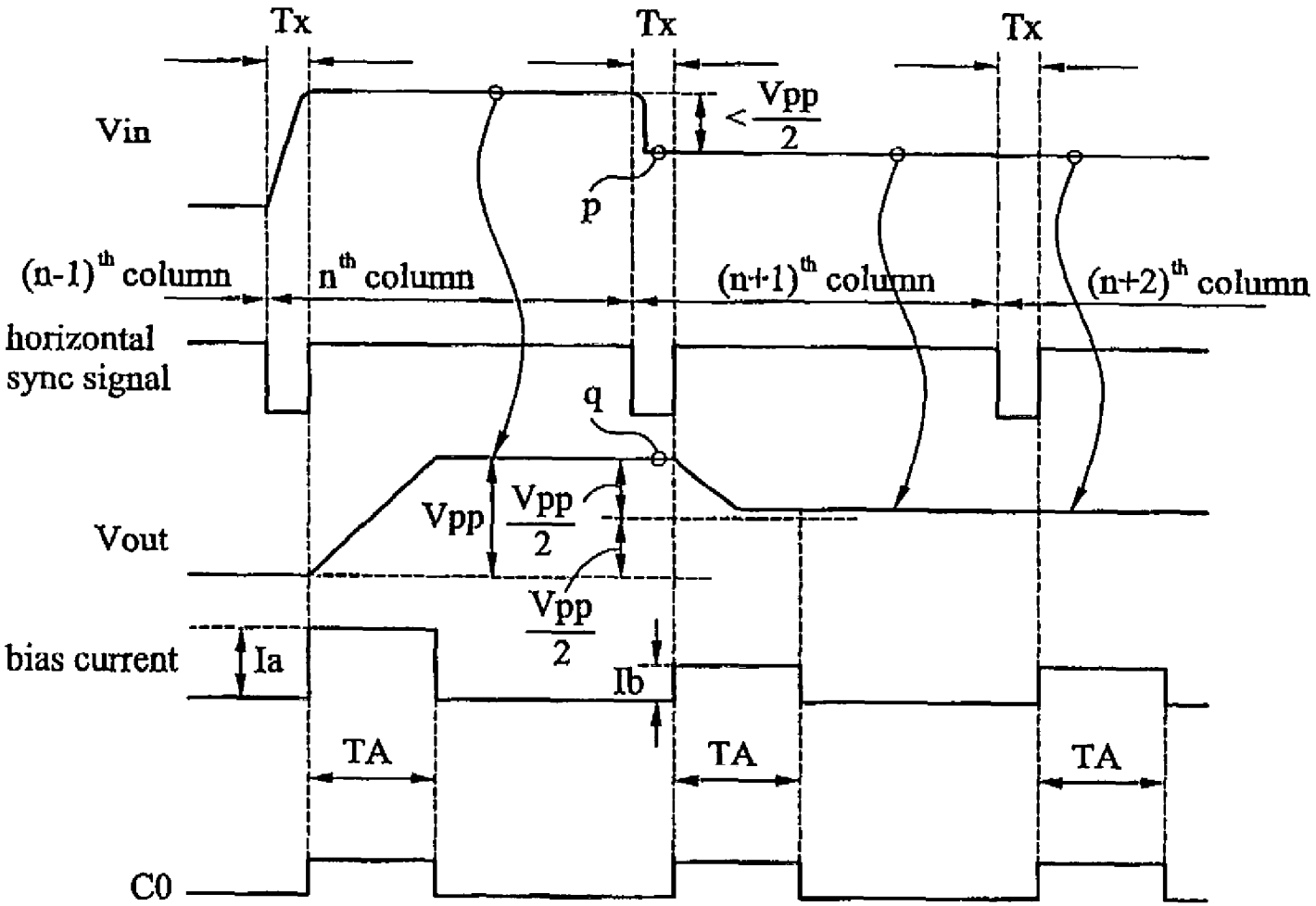
FIG. 6 is a timing chart showing waveforms of signals in the driving circuit of FIG. 3.

FIG. 6 shows the operation of the driving circuit of FIG. 3, wherein the waveforms of the signals the same as those of FIG. 2 are respectively shown from the upper stage to the lower stage.

In this example, the horizontal scan period of the pixel data Vdata shifted from the (n−1)th to the $(n+2)^{th}$ columns is also shown. However, this embodiment is illustrated with respect to the condition, in which the control of the bias current is set into two stages and the threshold value is Vpp/2.

In the $n^{th}$ column, the grayscale voltage generating circuit 10 responds with the drop of the horizontal sync signal and generates the grayscale voltage (i.e., the driving signal Vin) corresponding to the pixel data Vdata. Next, when the horizontal sync signal rises after a period of time, the control signal C0 of the switch 30 becomes the high level and is kept high during the entire fixed period TA. The switch 30 is ON during the period of the high level control signal C0, so the constant current source 23*a* can output the current during the entire fixed period TA to supply the power to the complementary transistors 21 and 22 according to the bias current of the constant current source 23*a*. The bias current value is the current value Ia regulated by the bias control signal generated by the control circuit 60. Thus, the output Vout of the amplifier 20A slowly approaches the value of the driving signal Vin serving as the target value in the entire fixed period TA at the passing rate regulated by the bias current value Ia. In this example, the value of Vin of the $(n-1)^{th}$ column becomes the minimum, and the value of Vin of the $n^{th}$ column becomes the maximum. The transistors 21 and 22 generate the bias control signal capable of changing the level of the output Vout according to the maximum variation (maximum output amplitude) Vpp from the minimum value to the maximum value in the period TA. At this time, the pixel data difference obtained from the subtracter 64 (see FIG. 4) is the maximum in the control circuit 60, and the LUT 65 outputs the value of the bias control signal corresponding to the maximum level.

Next, in the $(n+1)^{th}$ column, the grayscale voltage generating circuit 10 herein also responds to the drop of the horizontal sync signal and generates the driving signal Vin of the pixel data Vdata. Also, the control signal C0 of the switch 30 becomes the high level and is kept high during the entire fixed period TA in response to the rise of the horizontal sync signal. Similarly, the switch 30 and the constant current source 23 are set to ON. However, if the value of Vin of the $(n+1)^{th}$ column becomes an intermediate value, and the difference between the value of Vin of the $(n+1)^{th}$ column and that of the $n^{th}$ column is less than one half (Vpp/2) of the maximum output amplitude Vpp, then the LUT 65 in the control circuit 60 outputs data less than one half of the value. As shown in FIG. 5, it is clear that the level of the bias current Ib can be used as the bias control signal. As shown in FIG. 6, the bias current Ib is one half of the bias current Ia, which passes the $n^{th}$ column.

Thus, the passing rate of the transistors 21 and 22 (i.e., the amplifier 20) is also reduced by half, and the voltage gradient of the output Vout of the amplifier 20A in the $(n+1)^{th}$ column becomes less than that of the $n^{th}$ column from the time the control signal C0 (switch 30) becomes ON to the time the target voltage Vin is reached. However, the voltage variation can be implemented according to one half of the maximum, so the target voltage Vin can be reached in the period TA when the switch 30 is set to ON.

In addition, in the $(n+2)^{th}$ column of this example, the value of Vin of the $(n+2)^{th}$ column may be completely the same as that of the previous column and becomes an intermediate value, wherein the difference between the target voltages Vin of the $(n+1)^{th}$ column and the $(n+2)^{th}$ column is zero. Thus, the LUT 65 of the control circuit 60 generates the low level bias control signal corresponding thereto, and the complementary transistors 21 and 22 operate according to the low bias current Ib. However, because the input Vin is kept unchanged and the voltage variation becomes zero, the output Vout is continuously held at the value of the previous column.

According to the embodiment of the invention, the bias current is changed according to the difference between the target voltage value of the previous column and the target voltage value of the present column (i.e., the variation of the output Vout) to adapt to the small bias current when the variation is small. The amplifier is enabled according to the aspect of the large bias current as the input when the variation is large. Thus, it is possible to achieve the target voltage in conjunction with the variation and the passing rate, which is not excessive, to prevent waste of bias current. Accordingly, overall power consumption of the driving circuit is reduced.

Also, if the column having the output variation of the $(n+2)^{th}$ column is zero, the switch 30 can be kept OFF. Because the output variation does not use the bias current when the column's value is 0, power conservation is further enhanced.

Figure 7:
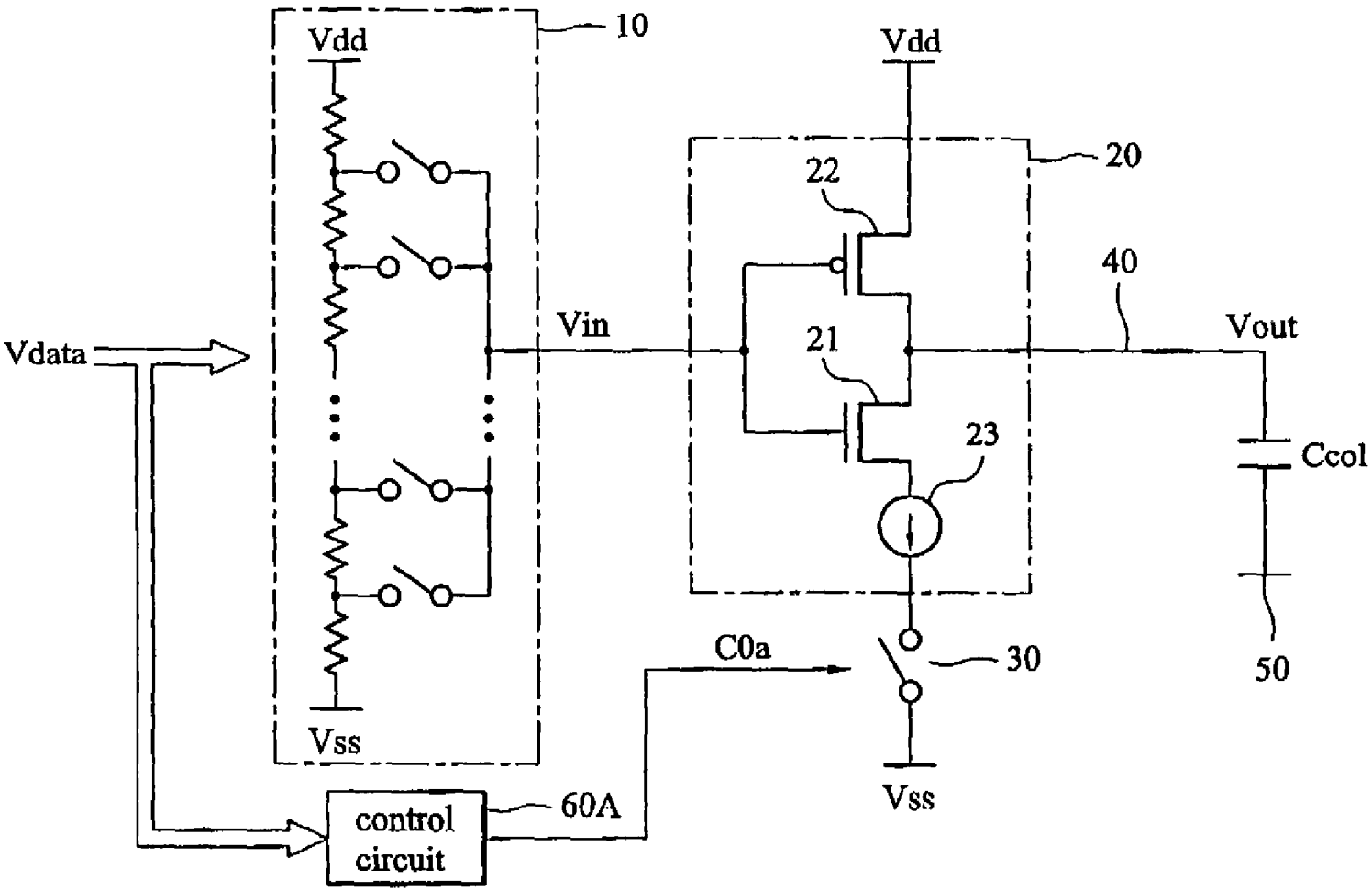
FIG. 7 is a circuit diagram showing an aspect of a row electrode driving circuit according to a second embodiment of the invention.

FIG. 7 is a circuit diagram showing an aspect of a row electrode driving circuit used in a liquid crystal display device according to a second embodiment of the invention, wherein the same symbol denotes the same part as FIGS. 1 and 3.

The driving circuit of FIG. 7 is different from the driving circuit of FIG. 3, and the bias current control is implemented according to the ON/OFF control of the switch 30. Thus, in this circuit, the constant current source 23 of the amplifier 20 does not have to be the source of FIG. 3 with the adjustable output current.

Herein, a control circuit 60A, which receives the pixel data Vdata and generates the suitable bias control signal C0*a* according to the pixel data Vdata, is provided. Rather than the control signal C0, the bias control signal C0*a* is supplied to the control end of the switch 30 to control ON/OFF status to reduce waste of the bias current of the amplifier 20. To perform such a control, the control circuit 60A detects a difference between a previous column value and a present column value of the pixel data Vdata, and sets the length of the current output period of the constant current source 23 according to the difference every time the sub-pixel data Vdata and the driving signal Vin are updated. Furthermore, the control circuit 60A generates the bias control signal C0*a* in each column such that the ON period of the switch 30 is assigned according to the pixel data difference.

Figure 8:
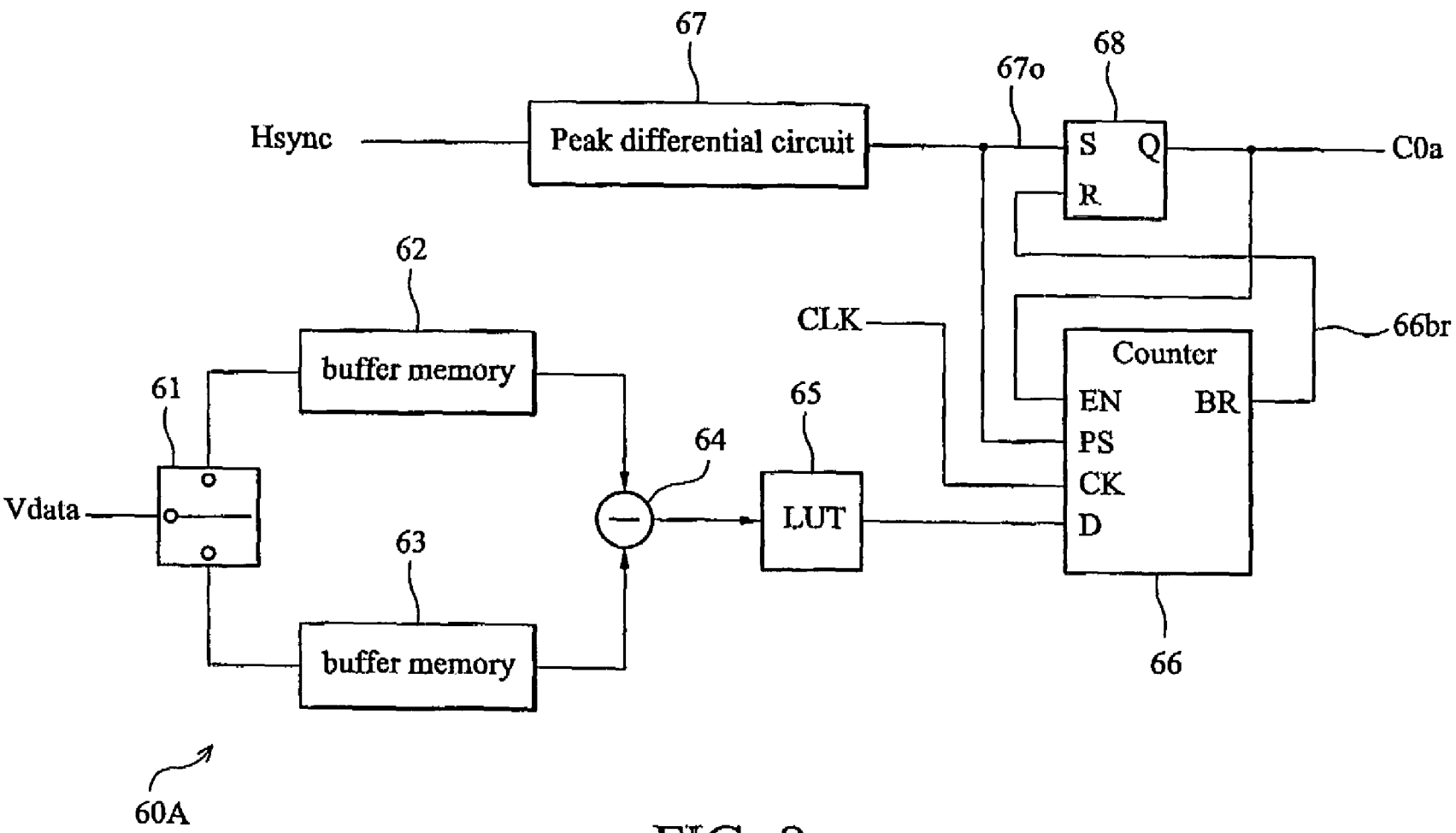
FIG. 8 is a block diagram showing an aspect of a control circuit in the driving circuit of FIG. 7.

FIG. 8 shows the embodied aspect of the control circuit 60A. The pixel data of the adjacent columns is held using the switching circuit 61 and the buffer memories 62 and 63. The subtracter 64 acquires the difference between the pixel data of the adjacent columns and to read the data corresponding to the difference from the LUT 65. This feature is the same as that of FIG. 4. However, the memory data of the LUT 65 is not the current setting value, but is the length of the current output period. The control circuit 60A includes, without limitation, a reverse counter 66, a peak differential circuit 67 and an S-R flip-flop circuit 68. The data read from the LUT 65 serves as the data input (to count initial value) of the reverse counter 66. A horizontal sync signal Hsync serves as the input of the peak differential circuit 67. The output 67*o* of the peak differential circuit 67 serves as the setting (S) input of the S-R flip-flop circuit 68, and the borrow output 66*br* of the counter 66 serves as the reset (R) input of the S-R flip-flop circuit 68. Also, the output 67*o* of the peak differential circuit 67 is connected to the default (PS) input of the counter 66, and the Q output of the flip-flop circuit 68 is connected to the enable (EN) input of the counter 66. The high-frequency clock signal coming from the timing generator (not shown) is supplied to the clock (CK) input of the counter 66. The Q output of the S-R flip-flop circuit 68 is output to serve as the bias control signal C0*a* controlling ON/OFF status of the switch 30.

Figure 9:
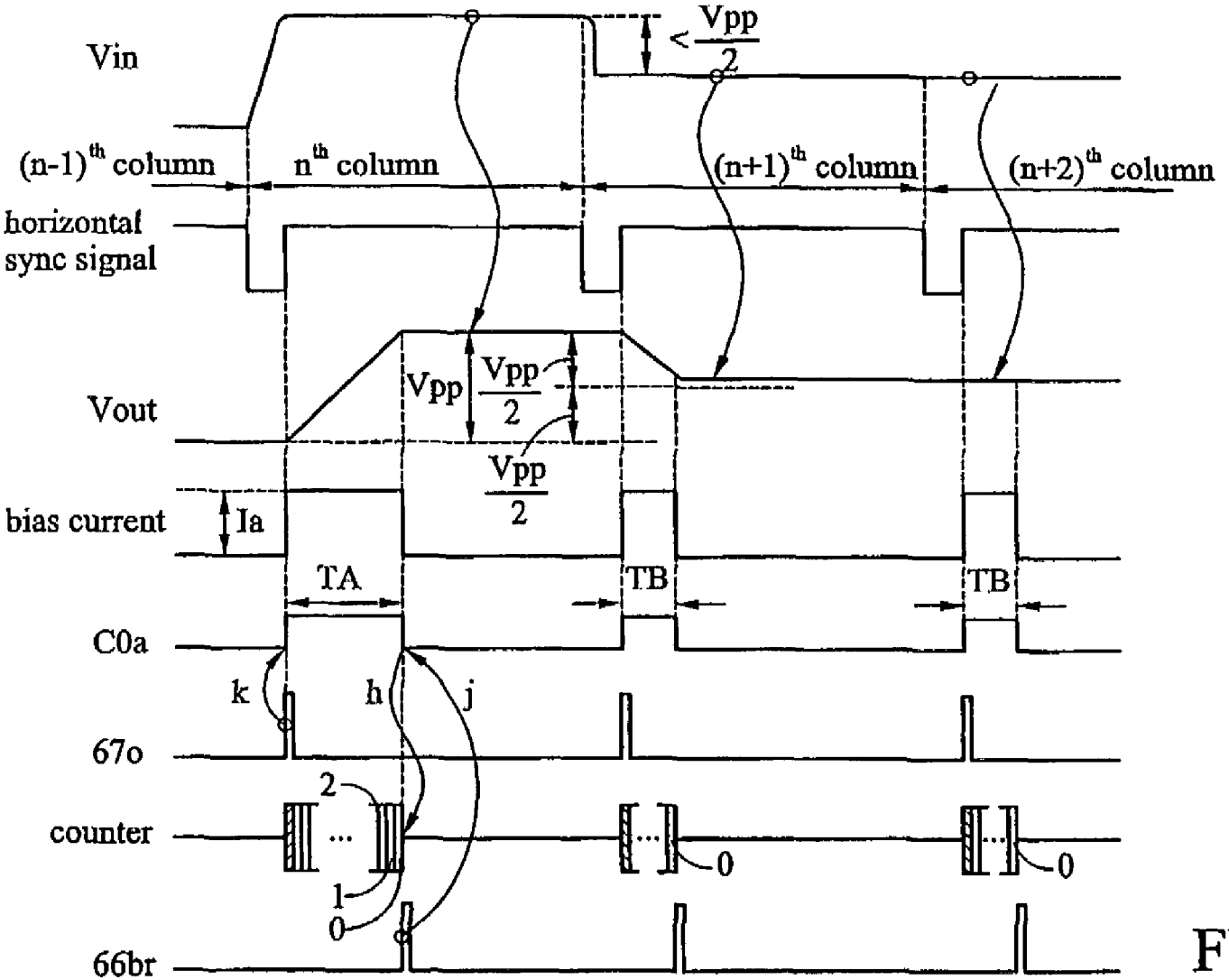
FIG. 9 is a timing chart showing waveforms of signals in the driving circuit of FIG. 7.

FIG. 9 shows operation of the driving circuit of FIG. 7 and the control circuit of FIG. 8, wherein the waveforms from the upper stage to the middle stage sequentially show the signals the same as those of FIGS. 2 and 6, and the lower three stages additionally show the waveforms of the signals of the control circuit 60A.

In the example shown, the horizontal scan period of the pixel data Vdata is shifted from the $(n-1)^{th}$ column to the $(n+2)^{th}$ column, the bias current is controlled in two stages, and the threshold value is equal to only Vpp/2.

In the $n^{th}$ column, the grayscale voltage generating circuit 10 responds with the drop of the horizontal sync signal Hsync and generates the driving signal Vin corresponding to the pixel data Vdata. Next, when the horizontal sync signal rises, the bias control signal C0*a* switches to a high level and is kept high through the overall period TA. The switch 30 is ON during the period when the control signal C0*a* is at the high level, so the constant current source 23 can output the current during the overall period TA, and thus supply power to the complementary transistors 21 and 22 according to the bias current of the constant current source 23*a*. The bias current value is the inherent current value Ia of the constant current source 23. Thus, the output Vout of the amplifier 20 slowly approaches the value of the driving signal Vin serving as the target value at the passing rate regulated by the bias current value Ia during the entire fixed period TA. In this example, the value of Vin of the $(n-1)^{th}$ column becomes the minimum, and the value of Vin of the $n^{th}$ column becomes the maximum. In the overall period TA, the transistors 21 and 22 can change the length of the output Vout according to the maximum variation (maximum output amplitude) Vpp from the minimum to the maximum, and generate the bias control signals to turn the switch 30 ON.

The bias control signal C0*a* is generated as follows. For example, in the $n^{th}$ column and the control circuit 60A, the pixel data difference obtained by the subtracter 64 of FIG. 8 is the maximum, and the data corresponding to the maximum is read from the LUT 65 and supplied to the data input of the counter 66. In the peak differential circuit, if the horizontal sync signal Hsync is multiplied by the differential of the peak, the peak differential output 67o rises to the high level according to the rising timing of the horizontal sync signal Hsync, as shown in FIG. 9. Responding, the flip-flop circuit 68 becomes a set state such that the bias control signal C0*a* is set at the high level (see arrow k), and the output 67*o* enables the counter 66 to set the data coming from the LUT 65 in advance. In FIG. 9, the state following presetting of the counter 66 is displayed using one hatched block. According to the flip-flop circuit 68 which becomes the set state, the Q output of the flip-flop circuit 68 enables the counter 66 to start counting. The data preset in the counter 66 corresponds to the initial count value of the length of the period TA.

Then, the counter 66 responds with the clock signal CLK to reduce the count value according to the preset value. The counter 66 counts its count value down when the clock signal CLK rises. Each hatched block in the section of the counter of FIG. 9 represents the descending count value.

Consequently, when the count value becomes zero, the counter 66 sets the BR output 66*br* at the high level. Thus, the flip-flop circuit 68 becomes the reset state, the bias control signal C0*a* is set to the low level (see arrow j) while the enabling input of the counter 66 becomes the low level such that the counting operation stops (see arrow h).

Accordingly, the high level bias control signal C0*a* can be generated by the flip-flop circuit 68 in the overall period TA with the length corresponding to the output data of the LUT 65 corresponding to the pixel data difference.

Then, in the $(n+1)^{th}$ column, the grayscale voltage generating circuit 10 also responds with the drop of the horizontal sync signal to generate the driving signal Vin corresponding to the pixel data Vdata. Also, responding to the rise of the horizontal sync signal, the control signal C0*a* of the switch 30 becomes the high level and is kept high during the entire period TB. Similarly, the switch 30 and the constant current source 23 switch ON. However, the value of Vin of the $(n+1)^{th}$ column becomes the intermediate value, and the difference between the value of Vin of $(n+1)^{th}$ column and that of the $n^{th}$ column becomes less than one half (Vpp/2) of the maximum output amplitude Vpp. Thus, the LUT 65 of the control circuit 60A outputs the data corresponding to one half of the value, and the bias control signal C0*a* for representing the shortened current output period TB is thus generated. The bias current herein is the same as that of the previous column and becomes Ia. As a result, as can be read from FIG. 9, the working time of the bias current (i.e., the sum) can be reduced as compared with that of the $n^{th}$ column. The circuit operation of the bias control signal C0*a* for generating the shortened current output period TB is the same as that during the period TA except that the initial count value corresponds to the point of the period TB.

Because the passing rate of the transistors 21 and 22 (i.e., the amplifier 20) remains unchanged, the output Vout of the amplifier 20 can reach the target voltage early since the voltage variation is less than that of the previous column. However, because the supply of the bias current is also stopped when the output Vout reaches the target voltage, wasted bias current will not be supplied after the output Vout reaches the target voltage.

In addition, in the $(n+2)^{th}$ column of this example, the value of Vin of the $(n+2)^{th}$ column is the same as that of the previous column and becomes the intermediate value, and the difference between the target voltages Vin of the (n+l)th column and the $(n+2)^{th}$ column is zero. So, the LUT 65 of the control circuit 60 outputs the small data corresponding to the value to the counter 66, and the bias control signal C0*a* with the shorter current output period is thus generated. The complementary transistors 21 and 22 are the same as those of the previous two stages, and function according to the bias current Ia. However, because the input Vin is kept unchanged and the voltage variation is zero, the output Vout is continuously held at the value of the previous column.

Thus, the length of the operation period of the bias current is changed according to the difference between the target voltage value of the previous column and that of the present column, i.e. the variation of the output Vout, to adapt to the short period when the variation is small. When the variation is large, the amplifier 20 is enabled through the input condition of the bias current in the long period. Thus, the target voltage can be reached in the bias operation period, which can match the variation and is not too long, waste of the bias current can be reduced, and the overall power consumption of the driving circuit can be suppressed.

Also, the switch 30 may be kept OFF in the column such as the $(n+2)^{th}$ column where the output variation is zero. Thus, the output variation does not have to use the bias current in the column with the output variation equal to zero, so power conservation may be further enhanced.

Figure 11:
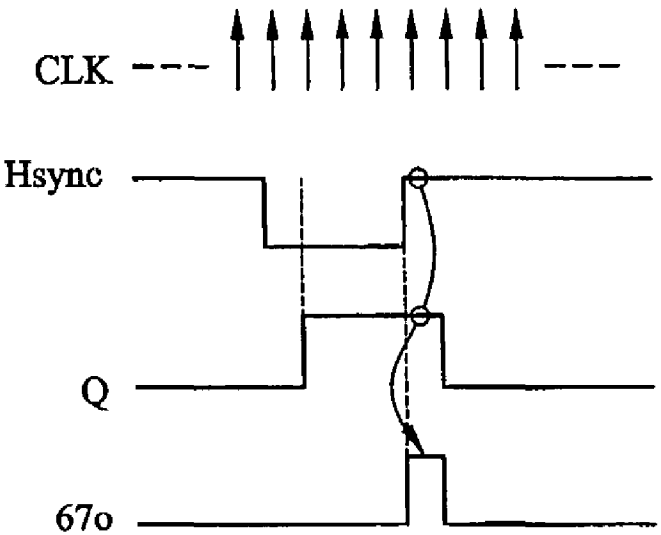
FIG. 11 is a timing chart showing operations of the peak differential circuit of FIG. 10.
Figure 10:
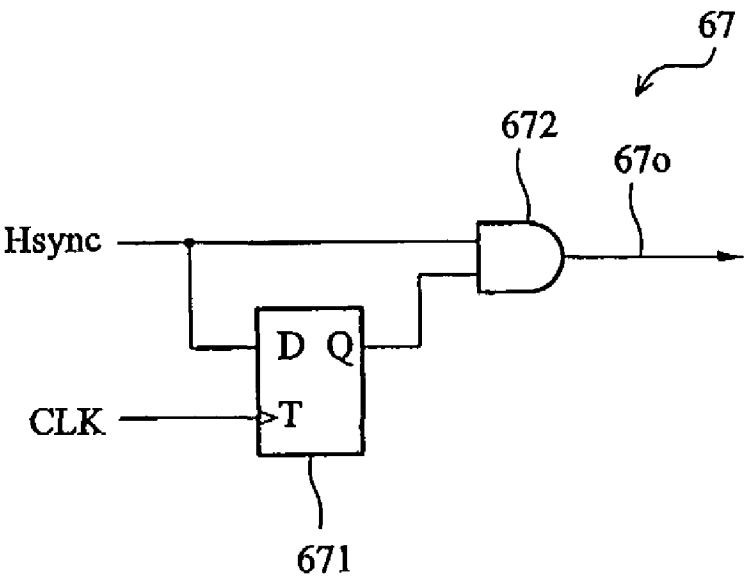
FIG. 10 is a circuit diagram showing an aspect of a peak differential circuit in the control circuit of FIG. 8.

The peak differential circuit 67 may have the aspect and operation shown in FIGS. 10 and 11. In FIG. 10, the peak differential circuit 67 has a D flip-flop circuit 671 and a logic AND circuit 672. The horizontal sync signal Hsync serves as the data input of the D flip-flop circuit 671, and the clock signal CLK serves as the trigger pulse input. The Q output of the flip-flop circuit 671 and the horizontal sync signal Hsync serve as the input of the logic AND circuit 672. The logic product of the AND circuit 672 is output and serves as the peak differential output 67*o*.

According to the aspect mentioned hereinabove, as shown in FIG. 11, the flip-flop circuit 671 can obtain the Q output, which is generated by delaying the horizontal sync signal Hsync by one cycle of the clock signal CLK and inverting the waveform of the horizontal sync signal Hsync. The AND circuit 672 obtains the logic product of the Q output and the horizontal sync signal Hsync. Thus, the switching of peak differential output 67o waveform to the high level can be obtained from the rise of the horizontal sync signal Hsync to the fall of the Q output (i.e., one cycle of the clock signal CLK).

Figure 12:
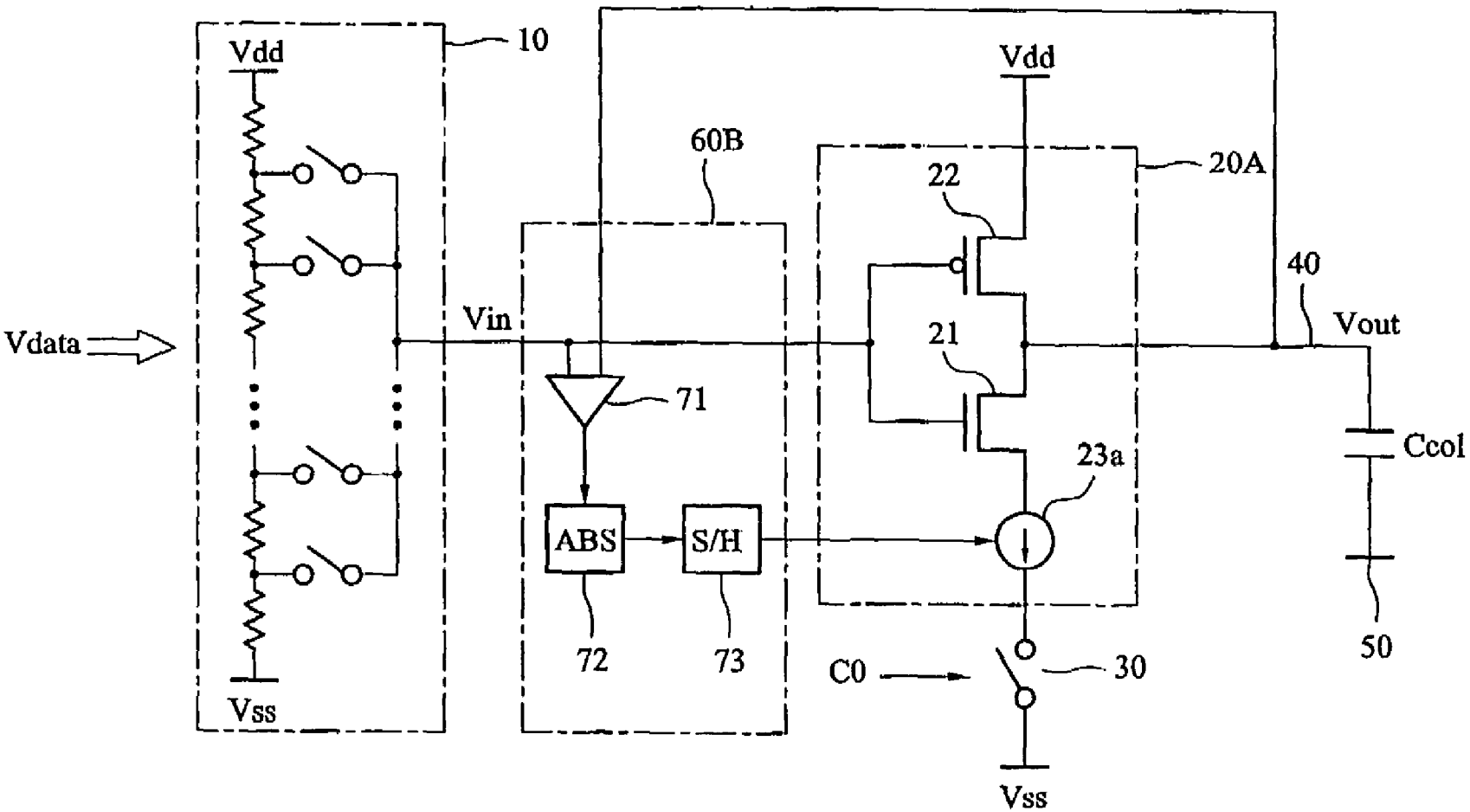
FIG. 12 is a circuit diagram showing an aspect of a row electrode driving circuit according to a third embodiment of the invention.

FIG. 12 shows the aspect of the row electrode driving circuit used in the liquid crystal display device according to the third embodiment of the invention, wherein the same symbol denotes the same element as that of FIGS. 1, 3 and 7.

The driving circuit of FIG. 12, which is the same as the driving circuit of FIG. 3, realizes the bias current control by changing the output current value of the constant current source 23*a*.

The internal aspect of the control circuit 60B particular to the driving circuit is specified as an analog circuit, and the suitable bias control signal is generated according to the output/input voltage of the amplifier 20A and then supplied to the control end of the constant current source 23*a* to control waste of the bias current of the amplifier 20A. To perform such a control, the control circuit 60B has a differential amplifier 71, an absolute-value circuit 72 and a sample and hold circuit 73. The input voltage and the output voltage serve as one input and the other input of the differential amplifier 71. The absolute-value circuit 72 generates a signal corresponding to an absolute value of the output of the differential amplifier. The sample and hold circuit 73 samples and holds the output of the absolute-value circuit 72. The output of the sample and hold circuit 73 serves as the bias control signal.

The differential amplifier 71 generates the output corresponding to the difference between the voltage of the driving signal Vin, which serves as the present target voltage, and the voltage, which serves as the previous target voltage and is guided out of the column 40. The absolute-value circuit 72 processes the output of the difference into the signal corresponding to the absolute value of the difference. Consequently, the bias current corresponding to the absolute value of the difference has to flow to the amplifier 20A even if the difference is negative when the output of the difference can represent two sides of the positive polarity and the negative polarity. The output of the absolute-value circuit 72 is supplied to the sample/hold (S/H) circuit 73. The voltage output corresponding to the absolute value is sampled with suitable timing, and the holding operation is maintained until the next column is sampled. The output of the sample and hold circuit 73 is supplied to the constant current source 23*a* to serve as the bias control signal updated in each column.

Suitable timing is set in the period Tx of FIG. 6. That is, when the time does not fall within the period, the difference between two voltages cannot be correctly obtained because the output Vout of the amplifier 20A is changed from the previous target voltage to the voltage close to the present target voltage. Thus, before this variation, as shown at the time p of FIG. 6, the present target voltage is obtained according to the input driving signal Vin, the previous target voltage is obtained according to the output driving signal Vout at the time q, and the absolute value of the difference between the previous target voltage and the present target voltage is obtained and held in the overall column. Thus, the suitable bias control signal can be generated.

According to this circuit aspect, the operations of FIG. 6 may be implemented to reduce power consumption. Also, the aspect of FIG. 12 is designed to control the bias current value but has the same purpose as that of FIG. 7, to change the ON period of the switch 30 and control the operation period of the bias current. At this time, there is provided a circuit for converting the output of the sample and hold circuit 73 to a digital value to replace the output of the LUT 65 (see FIG. 8). This may be implemented by setting the converted output as the default data input of the counter 66.

Also, the aspect of FIG. 12 is to dispose the sample and hold circuit at the output side of the control circuit 60B. Instead, the input voltage of the differential amplifier 71 may also be sampled/held. It is also possible to consider various aspects, each of which is equivalent to the aspect of FIG. 12.

Figure 13:
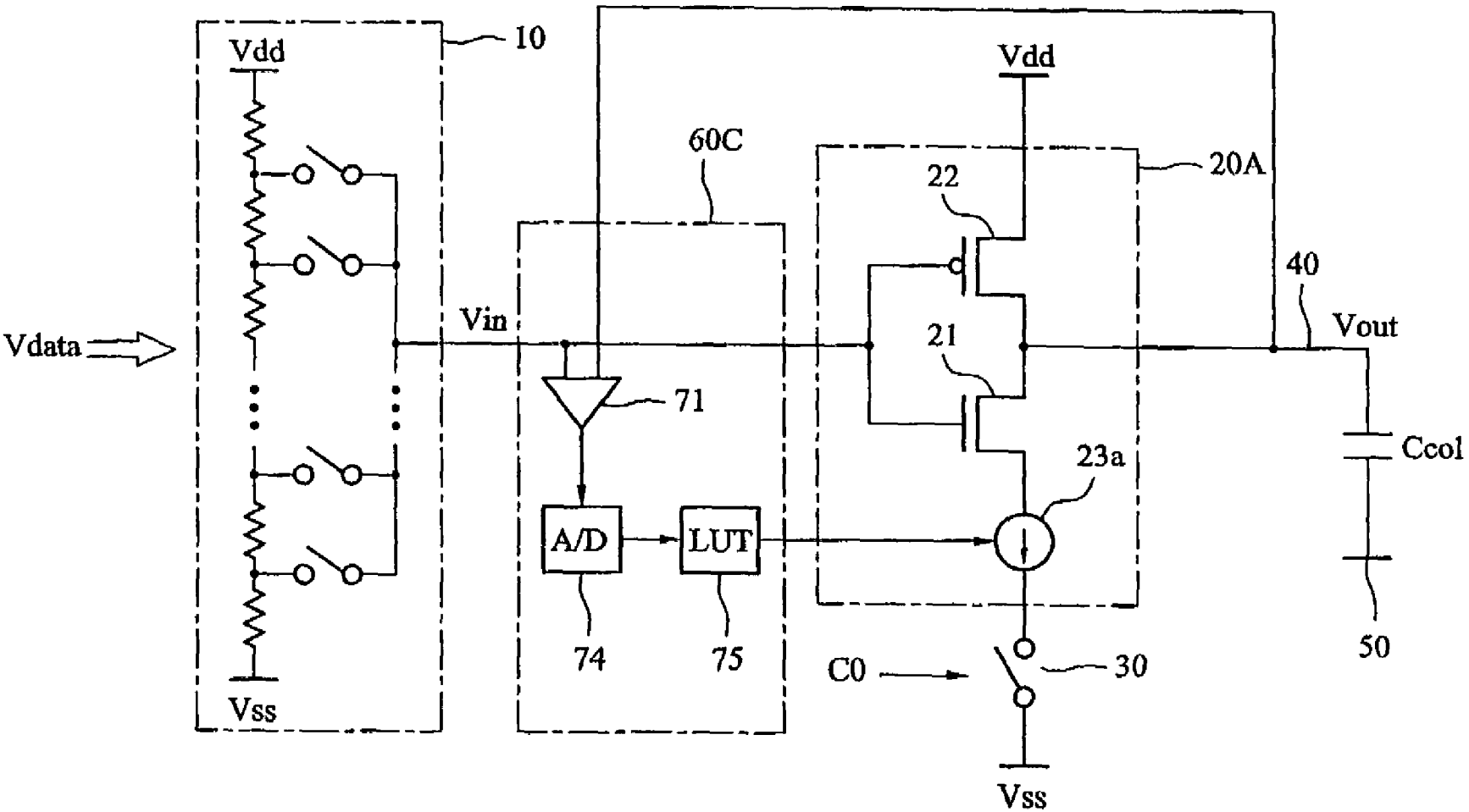
FIG. 13 is a circuit diagram showing an aspect of a row electrode driving circuit according to a fourth embodiment of the invention.

FIG. 13 depicts the aspect of the row electrode driving circuit used in the liquid crystal display device according to the fourth embodiment of the invention, wherein the same symbol denotes the same element as that of FIGS. 1, 3, 7 and 12.

The driving circuit of FIG. 13, which is the same as the driving circuit of FIG. 3, realizes the bias current control by changing the output current value of the constant current source 23*a*.

The internal aspect of the control circuit 60C particular to the driving circuit is set as an analog/digital hybrid circuit, and the suitable bias control signal is generated according to the output/input voltage of the amplifier 20A and then supplied to the control end of the constant current source 23*a* to control waste of bias current of the amplifier 20A. To perform such a control, the control circuit 60C has a differential amplifier 71, an analog-to-digital (A/D) converter 74 and a look-up table (LUT) 75. The input voltage and the output voltage serve as one input and the other input of the differential amplifier 71. The A/D converter 74 with the additional sample/hold function holds and digitizes the output of the differential amplifier The LUT 75 contains the values of the control level of the constant current source 23*a* corresponding to the available output value of the AID converter 74. The output of the LUT 75 is provided to the constant current source 23*a* to serve as the bias control signal.

The differential amplifier 71 generates the output of the difference between the voltage of the driving signal Vin, which serves as the present target voltage, and the voltage, which serves as the previous target voltage and is guided out of the column 40. The output of the difference of the voltage in the A/D converter 74 is sampled/held according to any time of period Tx, and the digital value corresponding to its held voltage is output. According to the output digital value, the corresponding memory data of the LUT 75 is assigned an address and read out The aspect of controlling the constant current source 23*a* according to the read output of the LUT 75 has been described in the embodiment of FIG. 3.

In this example, polarity of the output of the difference can be resolved in the LUT 75. That is, the memory data corresponding thereto will be prepared in the LUT 75 irrespective of polarity of the output of the difference.

According to the circuit aspect mentioned hereinabove, the operation of FIG. 6 may also be implemented to reduce power consumption. Also, the aspect of FIG. 13 controls the bias current value, but has the same purpose as that of FIG. 7. Also, the aspect of FIG. 13 may also be changed to control the bias current operation period by controlling the ON period of the switch 30. At this time, for example, the output of the LUT 75 may replace the output of the LUT 65 (see FIG. 8) and be set as the default data input of the counter 66.

Also, the aspect of FIG. 13 is to have the sample/hold function in the A/D converter 74. However, such a function may be implemented at the input side of the differential amplifier 71 instead. It is also possible to consider various aspects equivalent to the aspect of FIG. 13.

Figure 14:
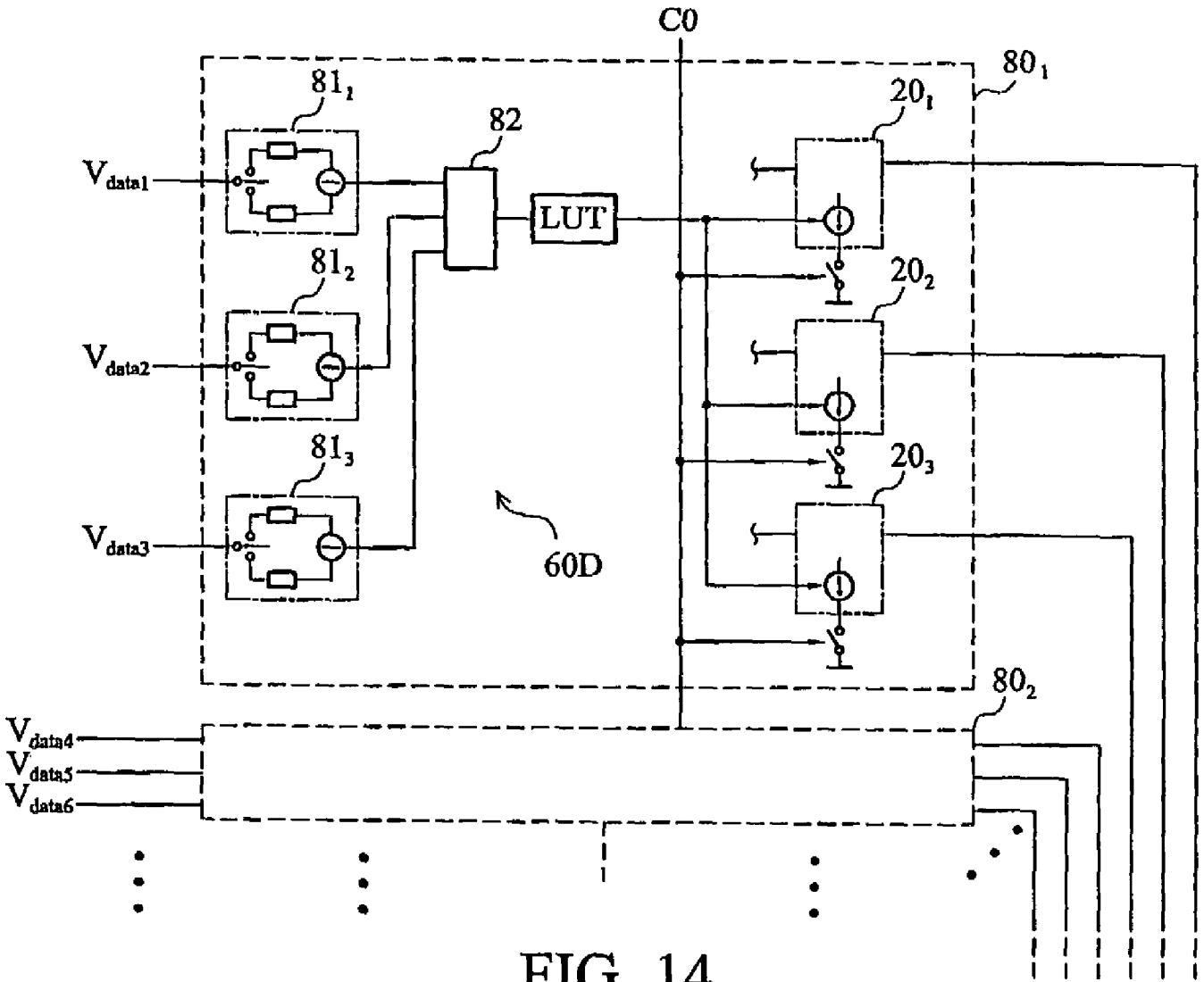
FIG. 14 is a block diagram showing the overall aspect of the driving circuit according to the invention.

FIG. 14 shows an example of performing a common bias control to a plurality of driving circuits. In this example, having the same aspect as that of the amplifier 20, each of the driving units ($\mathbf{80}_1$, $\mathbf{80}_2$, . . . ) has three amplifiers $\mathbf{20}_1$, $\mathbf{20}_2$ and $\mathbf{20}_3$ and the same bias control structure. The output of each of the amplifiers $\mathbf{20}_1$, $\mathbf{20}_2$ and $\mathbf{20}_3$ is coupled to a source line. The same bias control signal is supplied to the constant current sources of the amplifiers. The bias control signal in the driving unit is generated according to the output of one LUT. Pixel data difference between the adjacent columns at the address of the LUT is generated according to the following method.

The pixel data Vdata1, Vdata2, Vdata3, . . . is supplied to the blocks $\mathbf{81}_1$, $\mathbf{81}_2$ and $\mathbf{81}_3$, which are used to obtain the pixel data difference between the previous column and the present column,. Each block comprises the switching circuit, two buffer memories and one subtracter. The pixel data differences obtained in the three blocks are respectively supplied to a measurement circuit 82. The measurement circuit 82 judges and outputs the largest of the three differences. According to the difference obtained, the LUT represents the single read output respective to the three amplifiers, so the bias control of the amplifier with the maximum target voltage variation may also be applied to other amplifiers. The blocks $\mathbf{81}_1$, $\mathbf{81}_2$ and $\mathbf{81}_3$, the judging circuit 82 and the single LUT form the modified control circuit 60D.

According to such an implementation, the circuit scale can be reduced because the three amplifiers can share the LUT. Also, it is more effective when the displayed grayscale levels of the adjacent pixels approximate each other in the aspect of forming the driving unit for adjacent pixels. Also, the control signal C0 is not limited to only the driving unit, and may be commonly applied to all of the amplifiers.

The aspect of FIG. 14 is to perform the bias control by changing the output current value of the constant current source, but may also have the same purpose to that of the embodiment of FIG. 7. That is, the bias control may be performed by changing the ON period of the switch 30. In this case, the aspect of the LUT, which is the output side, can be replaced by the aspect including the counter as shown in FIG. 8.

Also, while one driving unit comprises three amplifiers in the example, two amplifiers, four amplifiers or more are equally applicable.

While the display panel is a liquid crystal display panel in the embodiments, the invention is not limited thereto. Any display device capable of driving the capacitance load can be utilized. Also, in the above-mentioned contents, the bias control method illustrated changes the current value of the constant current source and changes the length of the current output period of the constant current source. However, the method may simultaneously change the current value of the constant current source and the length of the current output period. The invention also includes the aspect of the combined method.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A driving circuit for driving a capacitance load of a display device, the driving circuit comprising:

a driving signal supply mechanism supplying a driving signal having a target voltage represented during periodic update;

an amplifier mechanism, comprising:

an amplifier part receiving the driving signal serving as an input and generating an output to the capacitance load according to the driving signal, a current-adjustable constant current source supplying and regulating a passing rate of a bias current to the amplifier part, and a switch part controlling ON/OFF status of a current output from the constant current source; and a control mechanism detecting a difference between a previous value and a present value of the target voltage during update to change a current value of the constant current source such that the bias current is higher when the difference is larger, wherein the control mechanism comprises:

a buffer memory storing the previous value and the present value of the driving signal; a subtracter obtaining the difference between the previous value and the present value recorded in the buffer memory; and a memory containing suitable current values of the constant current source according to the difference, wherein the constant current source sets the current value read from the memory according to an output of the subtracter.

2. The driving circuit according to claim 1, wherein the bias current is controlled to at least two stages.

3. The driving circuit according to claim 1, wherein the target voltage is updated during each horizontal scan period.

4. The driving circuit according to claim 1, wherein the target voltage is a grayscale voltage.

5. A display device, comprising a row driving circuit, wherein the row driving circuit is the driving circuit according to claim 1.

6. The display device according to claim 5, further comprising a plurality of row electrodes extending along a first axis of a frame, wherein the amplifier mechanism is disposed in each of the row electrodes, the outputs of the amplifier mechanism are coupled to the row electrodes, and the control mechanism is disposed in each of the row electrodes.

7. The display device according to claim 5, further comprising a plurality of row electrodes extending along a first axis of a frame, wherein the amplifier mechanism is disposed in each of the row electrodes, the outputs of the amplifier mechanism are coupled to the row electrode, and the control mechanism performs a common bias control to the amplifier mechanism associated with the row electrodes, and performs a control according to one maximum of the differences obtained by the amplifier mechanism associated with the row electrodes.

8. A driving circuit for driving a capacitance load of a display device, the driving circuit comprising:

a driving signal supply mechanism supplying a driving signal having a target voltage represented during periodic update;

an amplifier mechanism, comprising:

an amplifier part receiving the driving signal serving as an input and generating an output to the capacitance load according to the driving signal, a current-adjustable constant current source supplying and regulating a passing rate of a bias current to the amplifier part, and a switch part controlling ON/OFF status to a current output from the constant current source; and a control mechanism detecting a difference between a previous value and a present value of the target voltage during update to change a length of a current output period so that ON/OFF status of the switch part is controlled, such that a sum of the bias current is higher when the difference is larger, wherein the control mechanism comprises:

a buffer memory storing the previous value and the present value of the driving signal;

a subtracter obtaining the difference between the previous value and the present value recorded in the buffer memory; and a memory storing, in advance, suitable lengths of the current output period of the constant current source according to the difference, wherein the switch part sets, according to an output of the subtracter, the constant current source to ON in a period corresponding to the length of the current output period read from the memory.

9. The driving circuit according to claim 2, wherein the sum of the bias current is controlled by at least two stages.

10. A driving circuit for driving a capacitance load of a display device, the driving circuit comprising:

a driving signal supply mechanism supplying a driving signal having a target voltage represented during periodic update;

an amplifier mechanism, comprising:

an amplifier part receiving the driving signal serving as an input and generating an output to the capacitance load according to the driving signal, a current-adjustable constant current source supplying and regulating a passing rate of a bias current to the amplifier part, and a switch part controlling ON/OFF status of a current output from the constant current source; and a control mechanism detecting a difference between a previous value and a present value of the target voltage during update to change a current value of the constant current source such that the bias current is higher when the difference is larger, wherein the control mechanism comprises:

a differential amplifier receiving the input of the amplifier mechanism, which serves as an input, and the output of the amplifier mechanism, which serves as another input, and outputting a difference between the inputs of the amplifier mechanism; and a sample/hold mechanism sampling and holding a voltage corresponding to the difference or a voltage of each of the inputs of the differential amplifier before the output of the amplifier mechanism changes from the previous value of the target voltage to the present value of the target voltage, wherein the constant current source can set the current value according to the output of the differential amplifier, obtained according to the held voltage or the input of the held voltage.

11. A driving circuit for driving a capacitance load of a display device, the driving circuit comprising:

a driving signal supply mechanism supplying a driving signal having a target voltage represented during periodic update;

an amplifier mechanism, comprising:

an amplifier part receiving the driving signal serving as an input and generating an output to the capacitance load according to the driving signal, a current-adjustable constant current source supplying and regulating a passing rate of a bias current to the amplifier part, and a switch part controlling ON/OFF status of a current output from the constant current source; and a control mechanism detecting a difference between a previous value and a present value of the target voltage during update to change a current value of the constant current source such that the bias current is higher when the difference is larger, wherein the control mechanism comprises:

a differential amplifier receiving the input of the amplifier mechanism, which serves as an input, and the output of the amplifier mechanism, which serves as another input, and outputting a difference between the inputs of the amplifier mechanism;

a sample/hold mechanism sampling and holding a voltage corresponding to the difference or a voltage of each of the inputs of the differential amplifier before the output of the amplifier mechanism changes from the previous value of the target voltage to the present value of the target voltage; and a memory storing suitable current values of the constant current source according to a digital value of a voltage, which is the held voltage or an output voltage of the differential amplifier according to the input of the held voltage, wherein the constant current source sets the current value, read from the memory, according to a digital value of the difference.

12. A driving circuit for driving a capacitance load of a display device, the driving circuit comprising:

a driving signal supply mechanism supplying a driving signal having a target voltage represented during periodic update;

an amplifier mechanism, comprising:

an amplifier part receiving the driving signal serving as an input and generating an output to the capacitance load according to the driving signal, a current-adjustable constant current source supplying and regulating a passing rate of a bias current to the amplifier part, and a switch part controlling ON/OFF status to a current output from the constant current source; and a control mechanism detecting a difference between a previous value and a present value of the target voltage during update to change a length of a current output period so that ON/OFF status of the switch part is controlled, such that a sum of the bias current is higher when the difference is larger, wherein the control mechanism comprises:

a differential amplifier receiving the input of the amplifier mechanism, which serves as an input, and the output of the amplifier mechanism, which serves as another input, and outputting a difference between the inputs of the amplifier mechanism; and a sample/hold mechanism sampling and holding a voltage corresponding to the difference or a voltage of each of the inputs of the differential amplifier before the output of the amplifier mechanism changes from the previous value of the target voltage to the present value of the target voltage, wherein the constant current source is set to ON by the switch part according to the output voltage of the differential amplifier, which is obtained according to the held voltage or the input of the held voltage, in the current output period corresponding to the length.

13. A driving circuit for driving a capacitance load of a display device, the driving circuit comprising:

a driving signal supply mechanism supplying a driving signal having a target voltage represented during periodic update;

an amplifier mechanism, comprising:

an amplifier part receiving the driving signal serving as an input and generating an output to the capacitance load according to the driving signal, a current-adjustable constant current source supplying and regulating a passing rate of a bias current to the amplifier part, and a switch part controlling ON/OFF status to a current output from the constant current source; and a control mechanism detecting a difference between a previous value and a present value of the target voltage during update to change a length of a current output period so that ON/OFF status of the switch part is controlled, such that a sum of the bias current is higher when the difference is larger, wherein the control mechanism comprises:

a differential amplifier receiving the input of the amplifier mechanism, which serves as an input, and the output of the amplifier mechanism, which serves as another input, and outputting a difference between the inputs of the amplifier mechanism;

a sample/hold mechanism sampling and holding a voltage corresponding to the difference or a voltage of each of the inputs of the differential amplifier before the output of the amplifier mechanism changes from the previous value of the target voltage to the present value of the target voltage; and a memory storing, in advance, suitable lengths of the current output period of the constant current source according to a digital value of a voltage of the output of the differential amplifier, which is obtained according to the held voltage or the input of the held voltage, wherein the constant current source is set to ON by the switch part according to a digital value of the difference in the length of the current output period, which is read from the memory.

* * * * *